US012687109B2

(12) United States Patent
Tan et al.

(10) Patent No.: US 12,687,109 B2
(45) Date of Patent: Jul. 21, 2026

(54) INTELLIGENT IDENTIFICATION METHOD OF AQUIFER DISTRIBUTION IN COMPLEX EDGE-WATER OIL AND GAS RESERVOIRS

(71) Applicant: Southwest Petroleum University, Chengdu City (CN)

(72) Inventors: Xiaohua Tan, Chengdu City (CN); Jinbo Li, Chengdu City (CN); Xiaobing Han, Chengdu City (CN); Xiaoping Li, Chengdu City (CN); Mingqing Kui, Chengdu City (CN); Zihan Zhao, Chengdu City (CN); Xixiang Liu, Chengdu City (CN); Tao Li, Chengdu City (CN); Youjie Xu, Chengdu City (CN); Yumin Li, Chengdu City (CN); Yongqiang Jin, Chengdu City (CN)

(73) Assignee: Southwest Petroleum University, Chengdu City (CN)

( * ) Notice: Subject to any disclaimer, the term of this patent is extended or adjusted under 35 U.S.C. 154(b) by 1043 days.

(21) Appl. No.: 17/863,698

(22) Filed: Jul. 13, 2022

(65) Prior Publication Data

US 2023/0258082 A1 Aug. 17, 2023

(30) Foreign Application Priority Data

Jan. 16, 2022 (CN) ..... 202210045763.2

(51) Int. Cl.
*E21B 49/08* (2006.01)
*E21B 47/06* (2012.01)

(52) U.S. Cl.
CPC ..... *E21B 49/0875* (2020.05); *E21B 47/06* (2013.01); *E21B 2200/20* (2020.05)

(58) Field of Classification Search
CPC ..... E21B 2200/20; E21B 47/06; E21B 49/00; E21B 49/0875; Y02A 10/40
See application file for complete search history.

(56) References Cited

U.S. PATENT DOCUMENTS

2015/0019183 A1* 1/2015 Suzuki ..... E21B 43/16 703/2
2017/0067323 A1* 3/2017 Katterbauer ..... G01V 20/00
2018/0137223 A1* 5/2018 Fung ..... E21B 43/16

OTHER PUBLICATIONS

Shimada, Munenori, and Turhan Yildiz. "Predicting water influx from common shared aquifers." SPE Europec featured at EAGE Conference and Exhibition?. SPE, 2009. (Year: 2009).*

(Continued)

*Primary Examiner* — Aniss Chad
(74) *Attorney, Agent, or Firm* — Dilworth & Barrese, LLP; Michael J. Musella, Esq.

(57) ABSTRACT

An intelligent identification method of aquifer distribution in complex edge-water oil and gas reservoirs is provided. The problem, that targeted water control countermeasures cannot be proposed due to unclear identification of edge-water distribution in complex edge-water reservoirs, is resolved. Based on geological data and production data of a single well, establish a numerical simulation model of a water influx unit for simulating inflow dynamic of complex edge-water influx; by a genetic algorithm, correct characteristic parameters of an aquifer unit, including volume and water influx of the aquifer unit; automatically fit dynamic production data calculated by the model with actual dynamic production data, to obtain optimal characteristic parameters of the aquifer unit; and assign the characteristic parameters to the aquifer unit for inversion to determine aquifer distribution. The method has simple steps and accuracy by comparing the result of aquifer distribution inversion and that of numerical simulator.

4 Claims, 10 Drawing Sheets

(56) References Cited

OTHER PUBLICATIONS

Yang, Yaozhong, et al. "Optimizing and accelerating history matching progress of numerical reservoir simulation by using material balance analysis." MATEC Web of Conferences. vol. 336. EDP Sciences, 2021. (Year: 2021).*

* cited by examiner

INTELLIGENT IDENTIFICATION METHOD OF AQUIFER DISTRIBUTION IN COMPLEX EDGE-WATER OIL AND GAS RESERVOIRS

This patent application claims the benefit and priority of Chinese Patent Application No. 202210045763.2, entitled "INTELLIGENT IDENTIFICATION METHOD OF AQUIFER DISTRIBUTION IN COMPLEX EDGE-WATER OIL RESERVOIRS" filed on Jan. 16, 2022, the disclosure of which is incorporated by reference herein in its entirety as part of the present application.

TECHNICAL FIELD

The present disclosure relates to an intelligent identification method of aquifer distribution in complex edge-water oil and gas reservoirs, and belongs to the technical field of oil and gas field development.

BACKGROUND ART

For an oil and gas reservoir with edge water, the oil and gas reservoir will be flooded due to the influence of water influx in a development stage of the oil and gas reservoir. The overall production regime of a production well will be affected after water breakthrough, thereby affecting the ultimate recovery factor of the oil and gas reservoir. Therefore, it is of great guiding significance to accurately understand the aquifer distribution characteristics of an oil and gas reservoir for selecting a reasonable water control measure for the oil and gas reservoir and adjusting a development plan. In the studies of aquifer characteristics, aquifer characteristics are characterized by means of characteristic parameters such as the aquifer volume and the water influx. However, these studies cannot characterize the distribution of aquifers, so the requirements of targeted treatment and adjustment of oil and gas reservoirs with water influx cannot be met.

At present, the distribution location of aquifers can be characterized by a physical model establishing method and a numerical simulation method. However, the two methods still have certain limitations. For the physical model establishing method, the water influx process of an oil and gas reservoir is a large-scale fluid movement, and there are insurmountable problems in realization of a physical model similar to a prototype. With development of computer technology, the numerical simulation method has a wider application scope, higher calculation efficiency, and lower cost. Many scholars use the numerical simulation method to simulate a dynamic process of water influx. At present, the numerical simulation method simulates the dynamic process of water influx mostly by establishing an aquifer based on geological data, and verifies accuracy of the model through history matching. There are two problems in this process: (1) for a numerical model with measurement errors or lack of geological data, the result of the established water model is not convincing enough; and (2) in the process of history matching of the model, there are too many parameters to be adjusted, so that the accuracy of the established aquifer model cannot be fully explained.

In general, the current methods for characterizing distribution of aquifers in complex edge-water oil and gas reservoirs have certain limitations. Therefore, an intelligent identification method of aquifer distribution suitable for complex edge-water oil and gas reservoirs is urgently needed.

SUMMARY

The objective of the present disclosure is: to solve the problem that targeted water control countermeasures cannot be carried out in the process of water influx of oil and gas reservoirs due to unclear understanding of aquifer distribution in complex edge-water reservoirs, thereby affecting the ultimate recovery factor of the oil and gas reservoirs, and based on single-well geological data and production data, aquifer characteristics are inverted on the basis of a numerical simulation method and an intelligent optimization algorithm, and re-identification of the aquifer distribution is realized.

To achieve the above objective, the present disclosure provides an intelligent identification method of aquifer distribution in complex edge-water oil and gas reservoirs, including:

first, establishing a numerical simulation model of a water influx unit: based on an aquifer unit, a production well unit and an infill unit, calculating the pressure, saturation and water cut of each unit by a material balance equation and a waterflood front advancing equation, and establishing the numerical simulation model of the water influx unit;

second, automatically fitting aquifer characteristic parameters: based on the numerical simulation model of the water influx unit, with actual dynamic production data as a reference, automatically correcting aquifer unit volume and aquifer unit cumulative water influx by a genetic algorithm to make data predicted by the model match the actual dynamic production data, and using the corrected aquifer unit volume and corrected aquifer unit cumulative water influx as aquifer characteristic parameters after the model is automatically fitted; and third, inverting aquifer distribution: after obtaining optimal solutions of the aquifer characteristic parameters, assigning the aquifer unit volume and the aquifer unit cumulative water influx to a discretized aquifer unit, establishing an aquifer unit bar chart, and determining aquifer distribution by the bar height of each unit.

In the intelligent identification method of aquifer distribution in complex edge-water oil and gas reservoirs, the step of establishing the numerical simulation model of the water influx unit specifically includes:

first, simply characterizing an edge-water oil and gas reservoir: discretizing an edge aquifer into the aquifer unit communicated with the production well unit; discretizing a position with clear geological knowledge into the infill unit; establishing a simple edge-water oil and gas and gas reservoir unit system based on the aquifer unit, the production well unit and the infill unit; and characterizing the aquifer unit by the aquifer unit volume and the aquifer unit cumulative water influx;

second, based on the aquifer unit, the production well unit and the infill unit, calculating the pressure of each unit by the material balance equation, which is expressed as:

$$\sum_{j=1}^{n_{well}} T_{ji}^{t}(p_j^t - p_i^t) + w_i^t = c_t \cdot V_i^t \cdot \frac{dp_i^t}{dt},$$

where $$T_{ij}^{t}$$

is an average conductivity between the aquifer unit i and the production well unit j at time t, $m^3/(d \cdot MPa)$; $n_{well}$ is a quantity of the production well units and infill units, dimensionless;

$$p_i^t$$

is a aquifer pressure of the aquifer unit i at time t, MPa;

$$p_j^t$$

is average bottom hole pressure of the production well unit j at time t, MPa;

$$w_i^t$$

is the cumulative water influx of the aquifer unit i at time t, $m^3/d$; $c_t$ is a comprehensive formation compressibility, $MPa^{-1}$; and $$V_j^t$$

is the aquifer volume of the aquifer unit i at time t, $m^3$;

third, using a finite difference method to solve a pressure solution of the material balance equation advancing from an old time step t to a new time step t+1, with a constructed pressure matrix as follows:

$$\begin{pmatrix} p_1^t \\ p_2^t \\ \vdots \\ p_n^t \end{pmatrix} = \begin{pmatrix} p_1^{t+1} \\ p_2^{t+1} \\ \vdots \\ p_n^{t+1} \end{pmatrix}.$$

$$\begin{pmatrix} \frac{\Delta t}{c_t \cdot V_1^{t+1}} \cdot \sum_{a=1}^{n} T_{1a}^t + 1 & -\frac{\Delta t}{c_t \cdot V_1^{t+1}} \cdot T_{12}^t & \cdots & -\frac{\Delta t}{c_t \cdot V_1^{t+1}} \cdot T_{1n}^t \\ -\frac{\Delta t}{c_t \cdot V_2^{t+1}} \cdot T_{21}^t & \frac{\Delta t}{c_t \cdot V_2^{t+1}} \cdot \sum_{a=1}^{n} T_{2a}^t + 1 & \cdots & -\frac{\Delta t}{c_t \cdot V_2^{t+1}} \cdot T_{2n}^t \\ \vdots & \vdots & \ddots & \vdots \\ -\frac{\Delta t}{c_t \cdot V_n^{t+1}} \cdot T_{n1}^t & -\frac{\Delta t}{c_t \cdot V_n^{t+1}} \cdot T_{n2}^t & \cdots & \frac{\Delta t}{c_t \cdot V_n^{t+1}} \cdot \sum_{a=1}^{n} T_{na}^t + 1 \end{pmatrix} - \begin{pmatrix} \frac{\Delta t}{c_t \cdot V_2^{t+1}} \cdot Q_1^t \\ \frac{\Delta t}{c_t \cdot V_2^{t+1}} \cdot Q_2^t \\ \vdots \\ \frac{\Delta t}{c_t \cdot V_2^{t+1}} \cdot Q_n^t \end{pmatrix},$$

where a is other units when a unit n is a research object, including the aquifer unit i and the production well unit j, dimensionless;

$$Q_n^t$$

represents flow of the unit n at time t, and since the unit n includes the aquifer unit i and the production well unit j, when $$Q_n^t$$

is positive, it is equal to the cumulative water influx, and when it is negative, it is equal to the production well output, $m^3/d$; and $\Delta t$ represents the time step, d; and fourth, according to the calculated pressure of each unit, calculating the saturation and water cut of each unit by using the waterflood front advancing equation, which is:

$$\left(\frac{dx}{dt}\right)_{Sw} = \frac{Q}{A\phi} \cdot \frac{\partial f_w}{\partial S_w},$$

where x is a position of a water influx channel, m; Q is total flow of fluid, $m^3$; $S_w$ is the water saturation at position x, dimensionless; $f_w$ is partial flow of a water phase, dimensionless; A is a cross-sectional area of a seepage, $m^2$; and $\phi$ is porosity, dimensionless.

In the intelligent identification method of aquifer distribution in complex edge-water oil and gas reservoirs, the step of automatically fitting the aquifer characteristic parameters specifically includes:

first, establishing characteristic parameter vectors and an objective function of the aquifer unit according to the established numerical simulation model of the water influx unit, the established characteristic parameter vectors including the aquifer unit volume and the aquifer unit cumulative water influx, with an expression as: $m=\lfloor V_1, \ldots, V_i, \ldots, V_{n_{water}}, w_1, \ldots, w_i, \ldots, w_{n_{water}} \rfloor$, and the established objective function is expressed as:

$$Y(m)_{min} = \exp \frac{\text{sum}[ydata - F(m)]^2}{n_{water}},$$

where m is the characteristic parameter vector of the aquifer unit; Y(m) is the objective function of the aquifer unit; ydata is observed dynamic data; and F(m) is dynamic data calculated by the model correcting the characteristic parameters of the aquifer unit;

second, setting constraints on the aquifer unit volume, and considering that the aquifer unit volume is equal to a size of the entire edge-water aquifer; and third, automatically fitting the aquifer unit volume and the aquifer unit cumulative water influx by the genetic algorithm, until the error value between the data predicted by the model and the actual dynamic production data is minimum, thereby obtaining the corrected aquifer unit volume and the corrected aquifer unit cumulative water influx.

DETAILED DESCRIPTION OF THE EMBODIMENTS

The present disclosure is further described below with reference to the embodiment and accompanying drawings.

Figure 1:
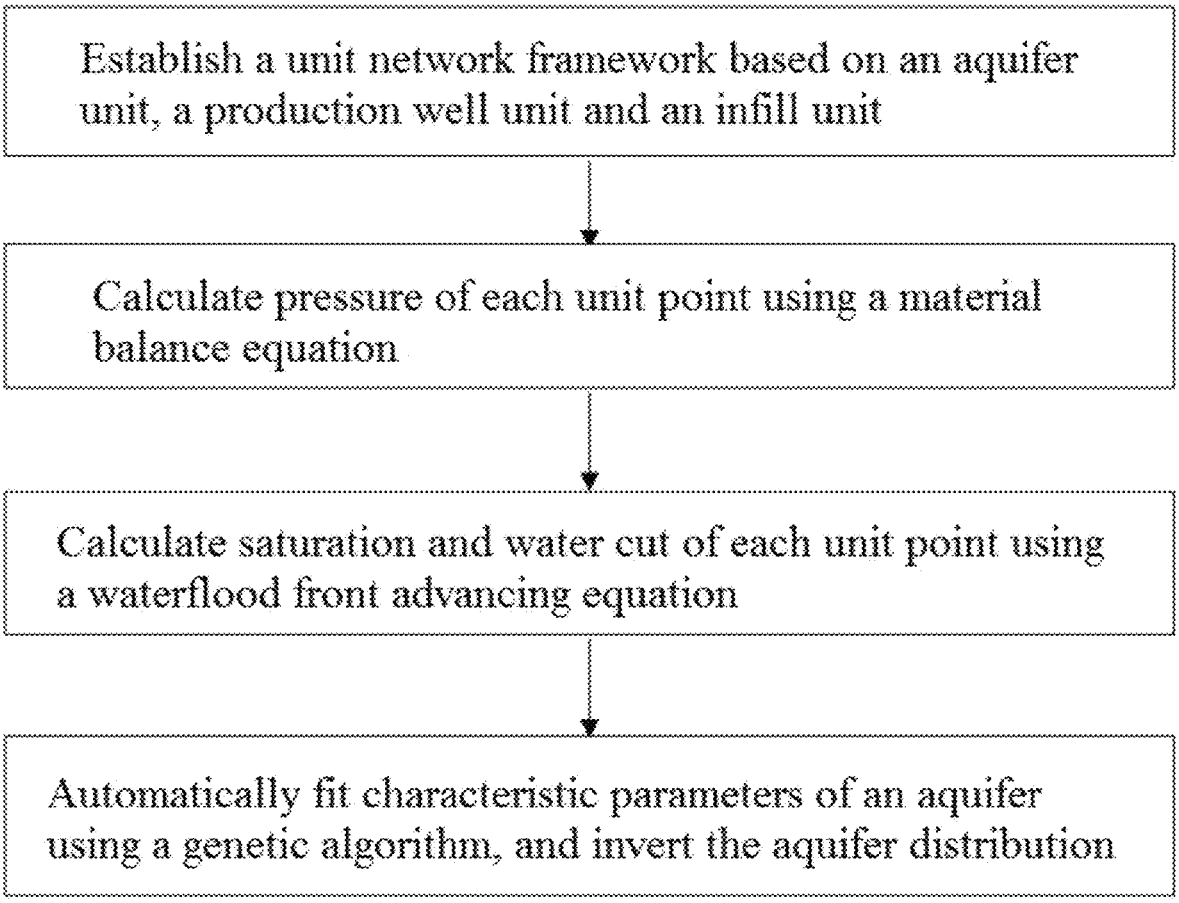
FIG. 1 is a diagram showing a technical route of the present method.

The present disclosure provides an intelligent identification method of aquifer distribution in complex edge-water oil and gas reservoirs, FIG. 1 is a diagram showing a technical route of the present disclosure, and the method includes the following steps:

First, a numerical simulation model of a water influx unit is established: based on an aquifer unit, a production well unit, and an infill unit, the pressure, saturation and water cut of each unit are calculated by a material balance equation and a waterflood front advancing equation to establish the numerical simulation model of the water influx unit.

Second, aquifer characteristic parameters are automatically fitted: based on the numerical simulation model of the water influx unit, with actual dynamic production data as a reference, two characteristic parameters, namely volume and water influx of the aquifer unit are automatically corrected by a genetic algorithm to make data predicted by the model match the actual dynamic production data, and the corrected volume and water influx of the aquifer unit are used as aquifer characteristic parameters after the model is automatically fitted.

Figure 2:
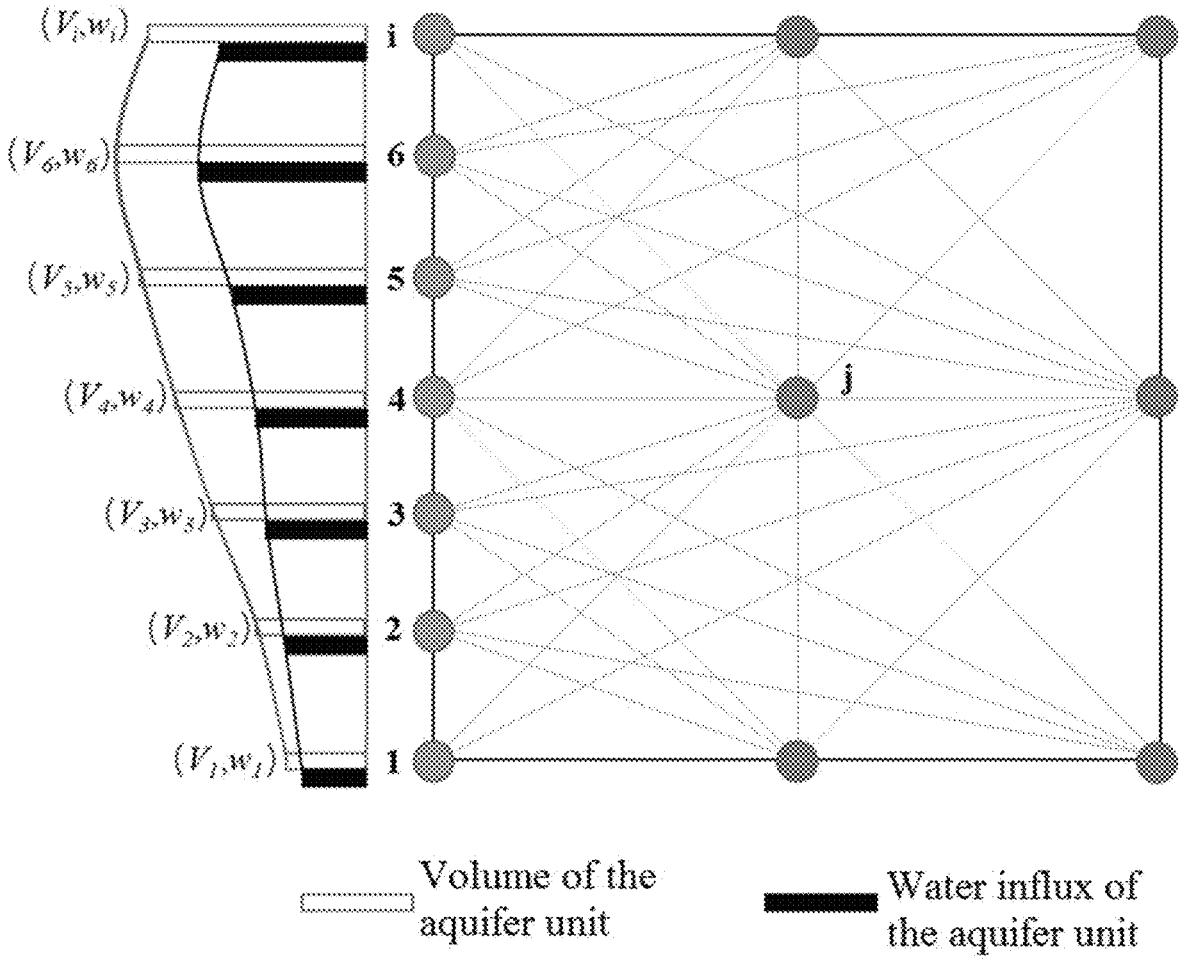
FIG. 2 is a schematic diagram showing aquifer distribution inversion.

Third, aquifer distribution is inverted: after optimal solutions of the aquifer characteristic parameters are obtained, the two characteristic parameters, namely the volume and water influx of the aquifer unit are assigned to a discretized aquifer unit, an aquifer unit bar chart is established, and aquifer distribution is determined by the bar height of each unit. The final aquifer distribution inversion result are shown in FIG. 2.

Further, the step of establishing the numerical simulation model of the water influx unit specifically includes the following steps:

First, an edge-water oil and gas reservoir is simply characterized: an edge aquifer is discretized into the aquifer unit communicated with the production well unit; a position with clear geological knowledge is discretized into the infill unit; a simple edge-water oil and gas reservoir unit system based on the aquifer unit, the production well unit and the infill unit is established; and the aquifer unit is characterized by two parameters, namely the volume and the cumulative water influx of the aquifer unit.

Second, based on the aquifer unit, the production well unit and the infill unit, the pressure of each unit is calculated by the material balance equation, which is expressed as:

$$\sum_{j=1}^{n_{well}} T_{ji}^{t}\left(p_j^t - p_i^t\right) + w_i^t = c_t \cdot V_i^t \cdot \frac{dp_i^t}{dt},$$

where $$T_{ij}^{t}$$

is an average conductivity between the aquifer unit i and the production well unit j at time t, $m^3/(d \cdot MPa)$; $n_{well}$ is the number of the production well units and infill units, dimensionless;

$$p_i^t$$

is aquifer pressure of the aquifer unit i at time t, MPa;

$$p_j^t$$

is average, bottom hole pressure of the production well unit j at time t, MPa;

$$w_i^t$$

is the water influx of the aquifer unit i at time t, $m^3/d$; $c_t$ is a comprehensive formation compressibility, $MPa^{-1}$; and $$V_j^t$$

is the aquifer volume of the aquifer unit i at time t, $m^3$.

Third, a finite difference method is used to solve a pressure solution of the material balance equation advancing from an old time step t to a new time step t+1, with a constructed pressure matrix as follows:

$$\begin{pmatrix} p_1^t \\ p_2^t \\ \vdots \\ p_n^t \end{pmatrix} = \begin{pmatrix} p_1^{t+1} \\ p_2^{t+1} \\ \vdots \\ p_n^{t+1} \end{pmatrix}.$$

-continued $$\begin{pmatrix} \frac{\Delta t}{c_t \cdot V_1^{t+1}} \cdot \sum_{a=1}^{n} T_{1a}^t + 1 & -\frac{\Delta t}{c_t \cdot V_1^{t+1}} \cdot T_{12}^t & \cdots & -\frac{\Delta t}{c_t \cdot V_1^{t+1}} \cdot T_{1n}^t \\ -\frac{\Delta t}{c_t \cdot V_2^{t+1}} \cdot T_{21}^t & \frac{\Delta t}{c_t \cdot V_2^{t+1}} \cdot \sum_{a=1}^{n} T_{2a}^t + 1 & \cdots & -\frac{\Delta t}{c_t \cdot V_2^{t+1}} \cdot T_{2n}^t \\ \vdots & \vdots & \ddots & \vdots \\ -\frac{\Delta t}{c_t \cdot V_n^{t+1}} \cdot T_{n1}^t & -\frac{\Delta t}{c_t \cdot V_n^{t+1}} \cdot T_{n2}^t & \cdots & \frac{\Delta t}{c_t \cdot V_n^{t+1}} \cdot \sum_{a=1}^{n} T_{na}^t + 1 \end{pmatrix} - \begin{pmatrix} \frac{\Delta t}{c_t \cdot V_1^{t+1}} \cdot Q_1^t \\ \frac{\Delta t}{c_t \cdot V_2^{t+1}} \cdot Q_2^t \\ \vdots \\ \frac{\Delta t}{c_t \cdot V_2^{t+1}} \cdot Q_n^t \end{pmatrix},$$

where a is other units when a unit n is a research object, including the aquifer unit i and the production well unit j, dimensionless;

$$Q_n^t$$

represents flow of the unit n at time t, and since the unit n includes the aquifer unit i and the production well unit j, when $$Q_n^t$$

is positive, it is equal to the water influx, and when it is negative, it is equal to the production well output, $m^3/d$; and $\Delta t$ represents the time step, d.

Fourth, according to the calculated pressure of each unit, the saturation and water cut of each unit are calculated by using the waterflood front advancing equation, which is:

$$\left(\frac{dx}{dt}\right)_{S_w} = \frac{Q}{A\phi} \cdot \frac{\partial f_w}{\partial S_w},$$

where x is a position of a water influx channel, m; Q is total flow of fluid, $m^3$; $S_w$ is the water saturation at position x, dimensionless; $f_w$ is partial flow of a water phase, dimensionless; A is a cross-sectional area of a seepage, $m^2$; and $\phi$ is porosity, dimensionless.

In the intelligent identification method of aquifer distribution in the complex edge-water oil and gas reservoirs, the step of automatically fitting the aquifer characteristic parameters specifically includes the following steps:

First, characteristic parameter vectors and an objective function of the aquifer unit are established according to the established numerical simulation model of the water influx unit, and the established characteristic parameter vectors include the volume and water influx of the aquifer unit, with an expression as: $m=\lfloor V_1, \ldots, V_i, \ldots, V_{n_{water}}, w_1, \ldots, w_i, \ldots, w_{n_{water}} \rfloor$, and the established objective function is expressed as:

$$Y(m)_{min} = \exp \frac{\text{sum}[ydata - F(m)]^2}{n_{water}},$$

where m is the characteristic parameter vector of the aquifer unit; Y(m) is the objective function of the aquifer unit; ydata is observed dynamic data; and F(m) is dynamic data calculated by the model correcting the characteristic parameters of the aquifer unit.

Second, constraints are set on the volume of the aquifer unit, where the volume of the aquifer unit is considered as equal to a size of the entire edge-water aquifer.

Third, the two characteristic parameters, namely the volume and the water influx of the aquifer unit are automatically fitted by the genetic algorithm, until the error value between the data predicted by the model and the actual dynamic production data is minimum, thereby obtaining two aquifer characteristic parameters, namely the corrected volume and water influx of the aquifer unit.

Figure 3:
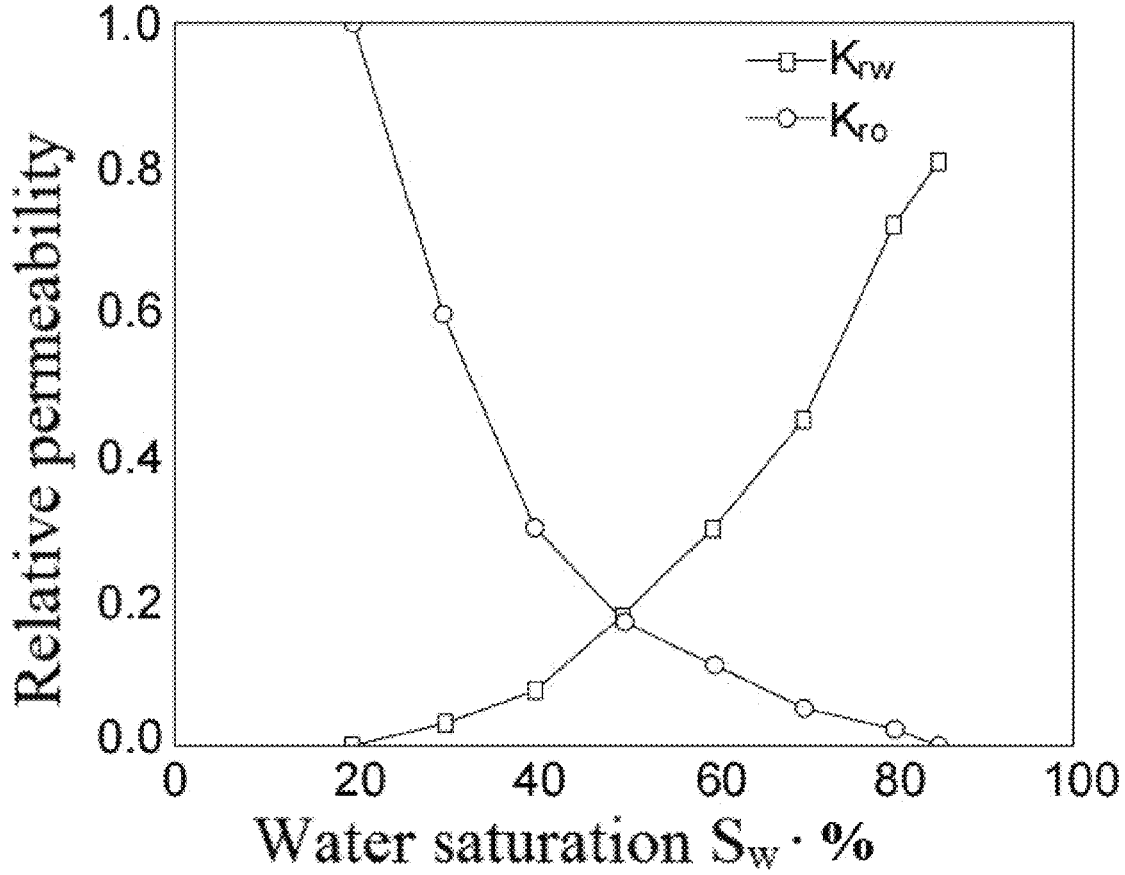
FIG. 3 is a curve graph showing relative permeability for an established numerical simulation.
Figure 4:
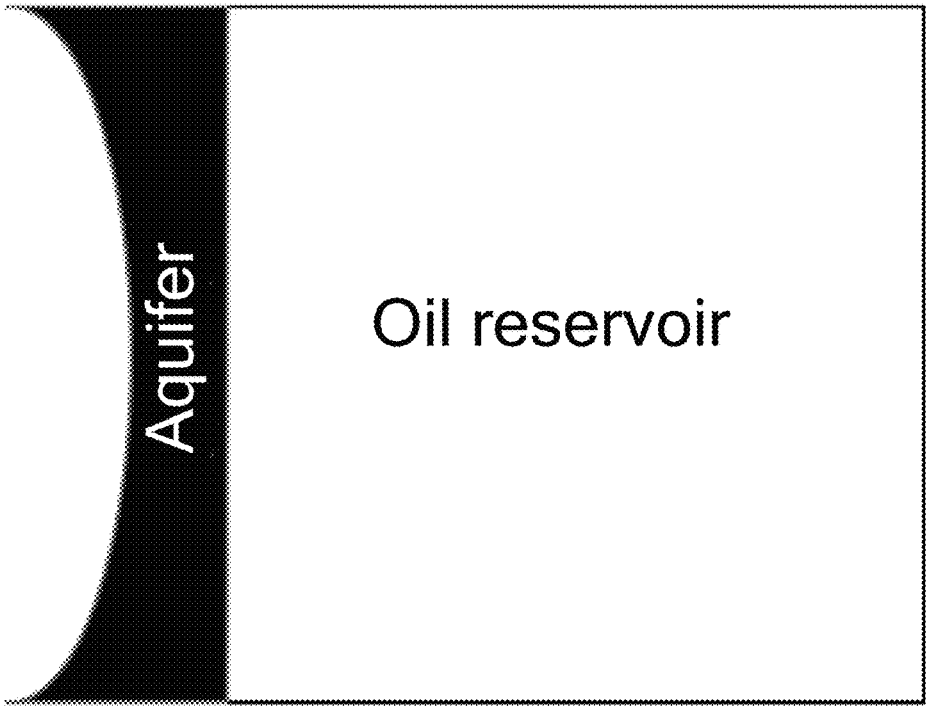
FIG. 4 is a schematic diagram showing concave aquifer distribution.
Figure 5A:
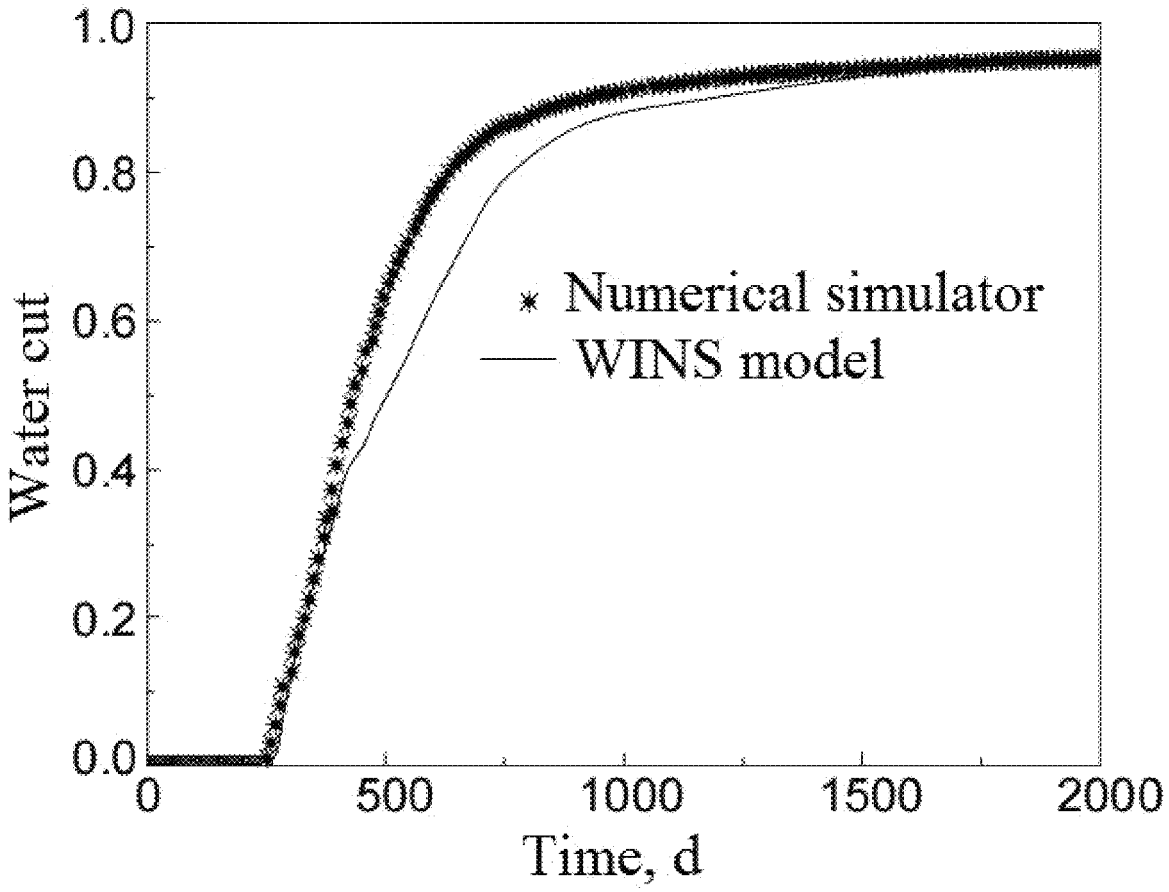
FIG. 5*a* is a diagram showing a fitting curve of the water cut of a well P1.
Figure 5B:
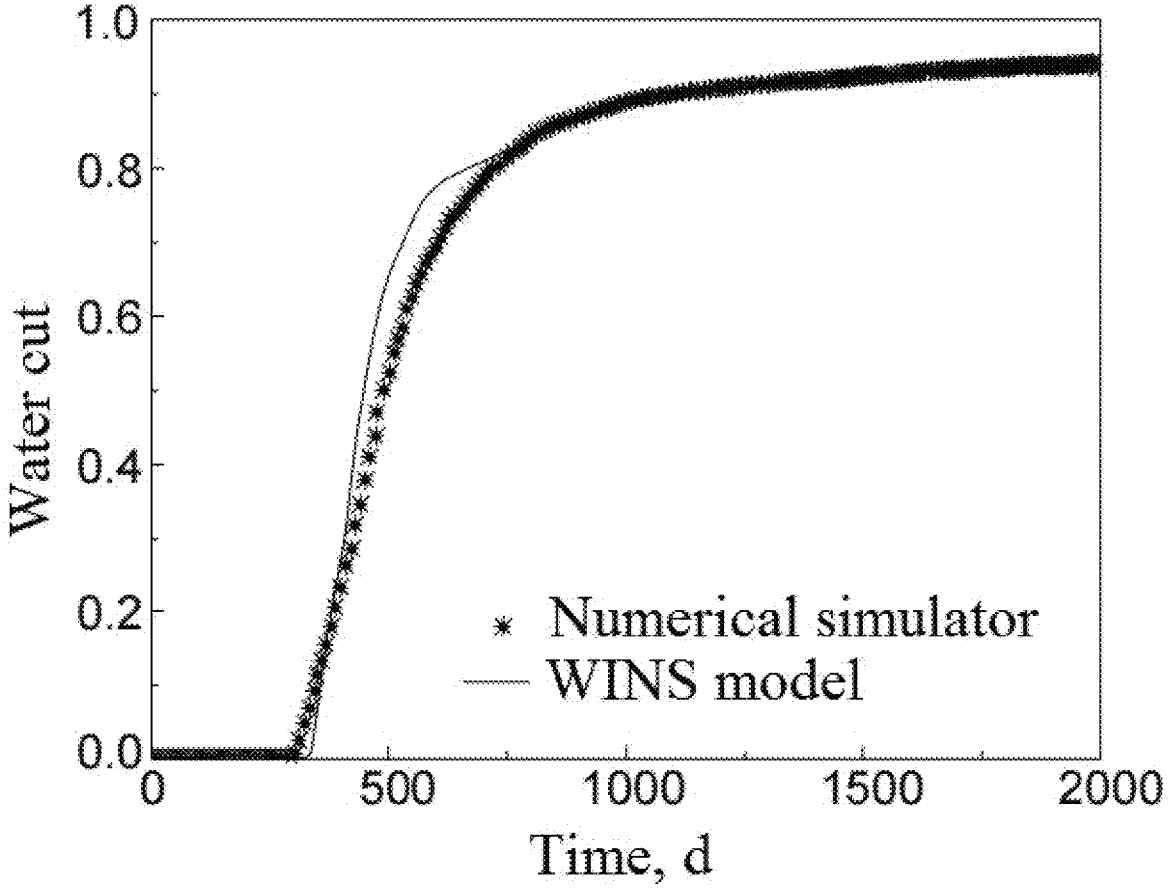
FIG. 5*b* is a diagram showing a fitting curve of the water cut of a well P2.
Figure 5C:
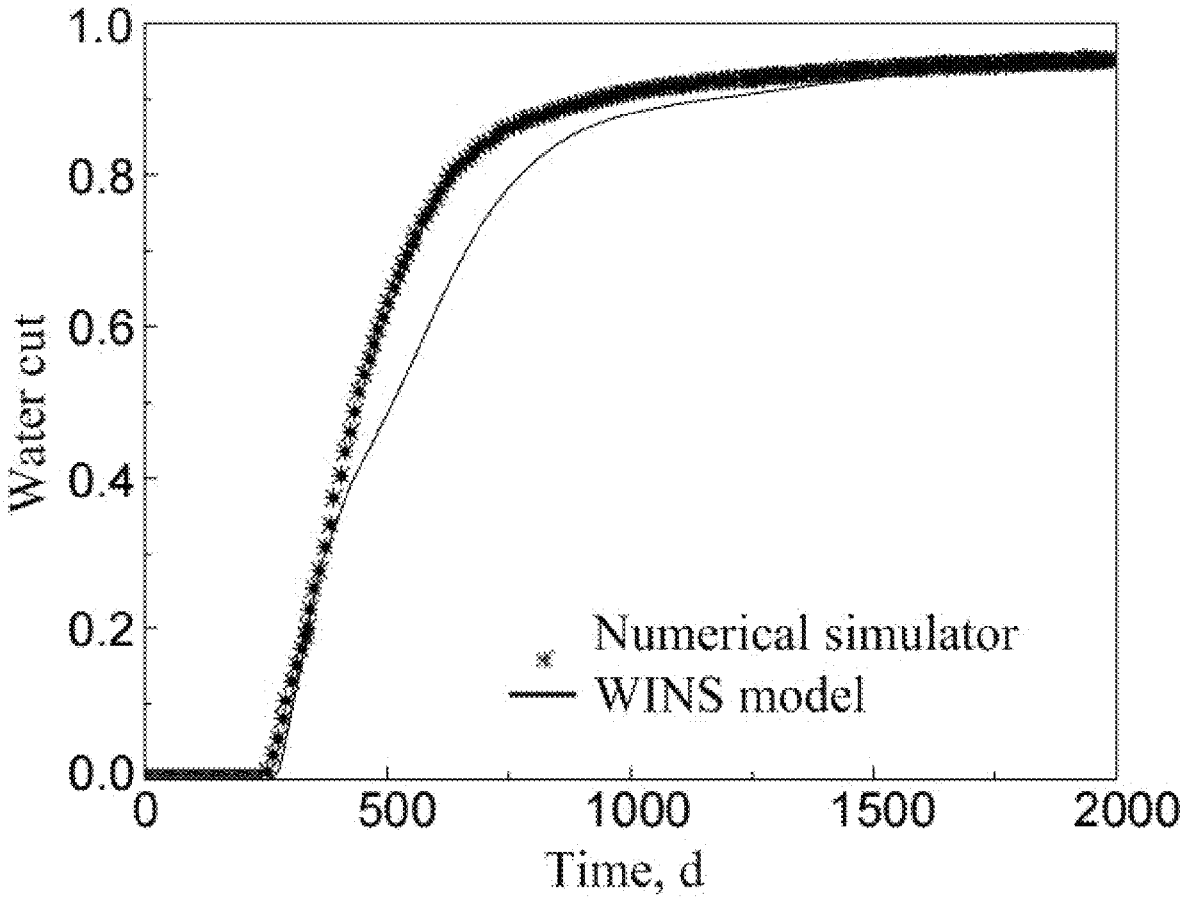
FIG. 5*c* is a diagram showing a fitting curve of the water cut of a well P3.
Figure 5D:
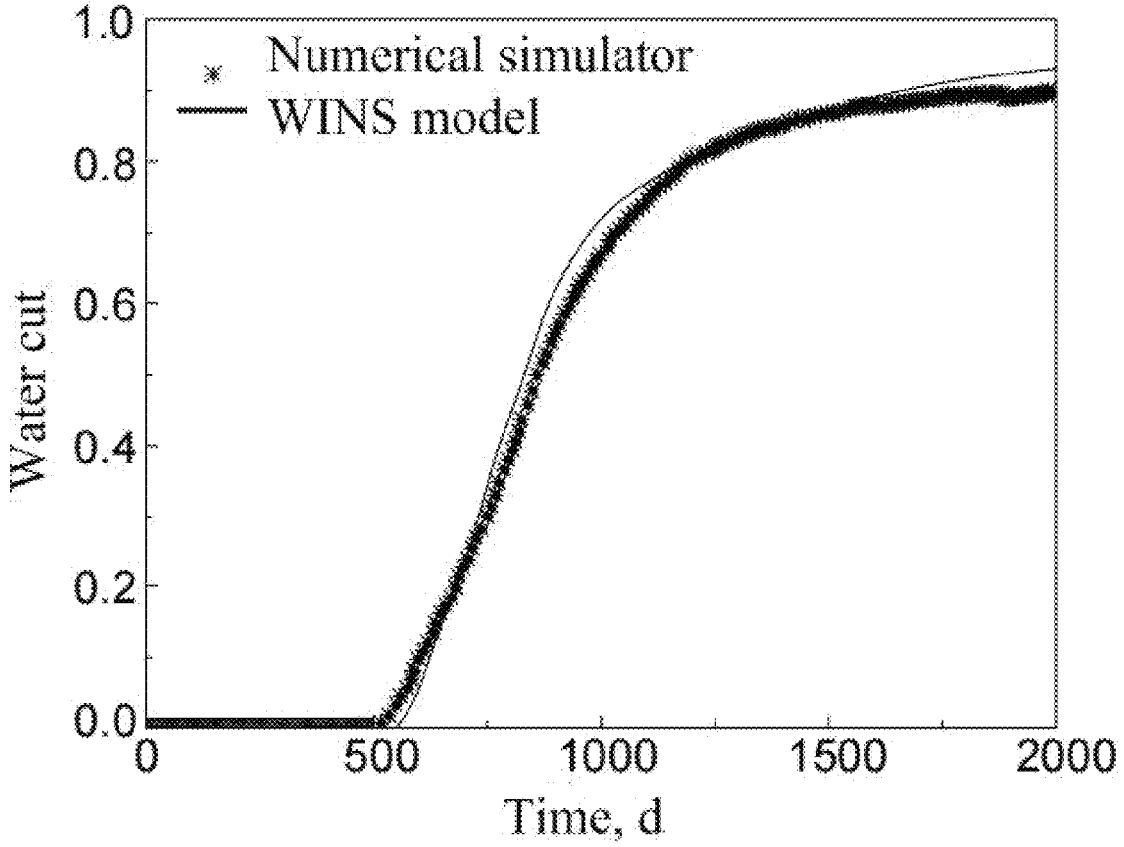
FIG. 5*d* is a diagram showing a fitting curve of the water cut of a well P4.
Figure 5E:
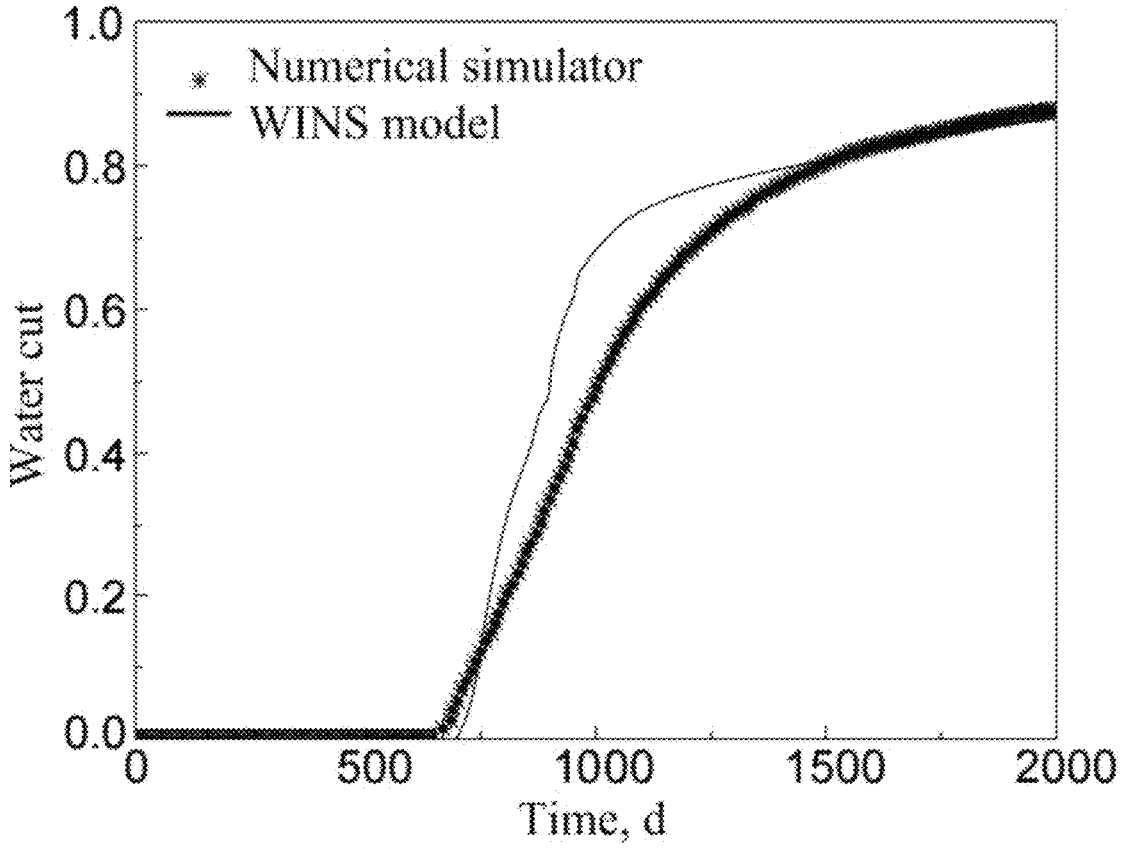
FIG. 5*e* is a diagram showing a fitting curve of the water cut of a well P5.
Figure 5F:
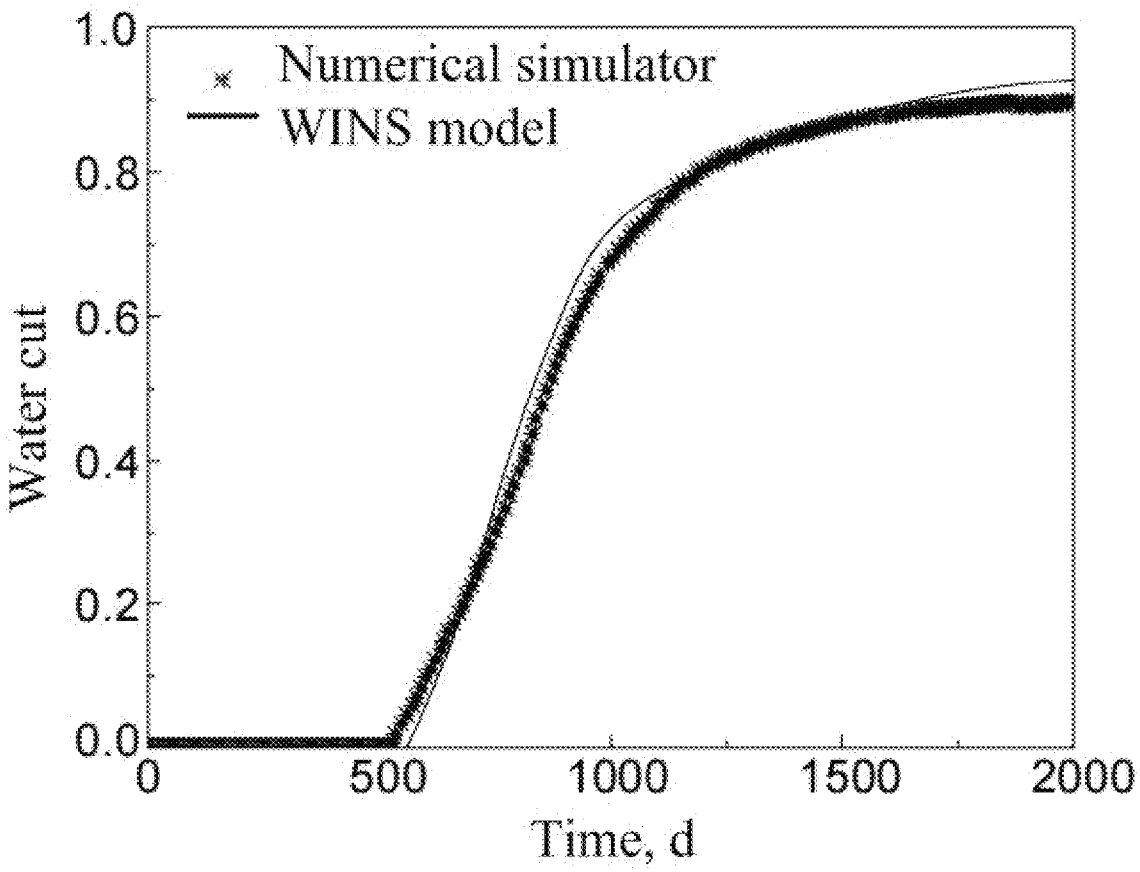
FIG. 5*f* is a diagram showing a fitting curve of the water cut of a well P6.

The model established by the method of the present disclosure is applied to a specific example as follows:

Using the model established herein, the calculation results of dynamic characteristics of water influx were compared with the results obtained by the numerical simulator. The numerical simulation model was verified by a black-oil model. The model grid was set to 50×50×1, the horizontal step size of each grid block was set to 10 m, the longitudinal step size was set to 20 m, and the simulation duration was 2000 days. The density of crude oil was 776 $kg/m^3$, the viscosity of crude oil was 20 cp, and the compressibility of crude oil was 0.005 $MPa^{-1}$. The relative permeability curve of an oil and gas reservoir was set as shown in FIG. 3. In the numerical simulation model, the numerical edge-water aquifer size was set to $1.8\times10^7$ $m^3$, and the aquifer distribution type is concave aquifer distribution, as shown in FIG. 4. Production wells were set as a constant fluid volume of production, respectively P1: 100 $m^3/d$, P2: 50 $m^3/d$, P3: 100 $m^3/d$, P4: 200 $m^3/d$, P5: 100 $m^3/d$, and P6: 200 $m^3/d$, and simulated production was 2000 d.

Production data of 2000 d was extracted. The water cut of the production wells P1-P6 predicted by the numerical simulator was used as an objective function of the model, and history matching of two characteristic parameters, namely the volume and water influx of the aquifer unit was carried out. It can be seen that in the validation of the concave aquifer model, the fitting effect of the water cut curve was good, the water breakthrough time of the production wells was consistent with the final water cut, and the fitting results of the water cut were shown in FIGS. 5*a*-5*f*.

Figure 6:
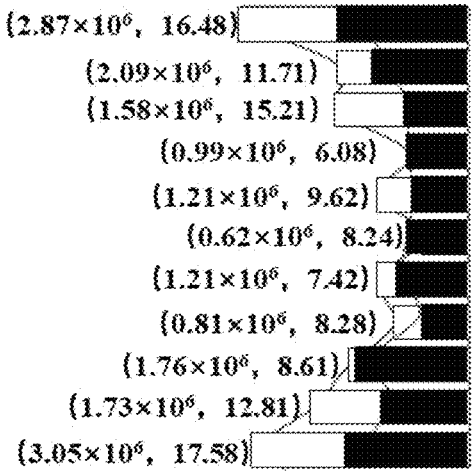
FIG. 6 is a diagram showing the inversion result of aquifer distribution automatically fitted by a model.
Figure 7:
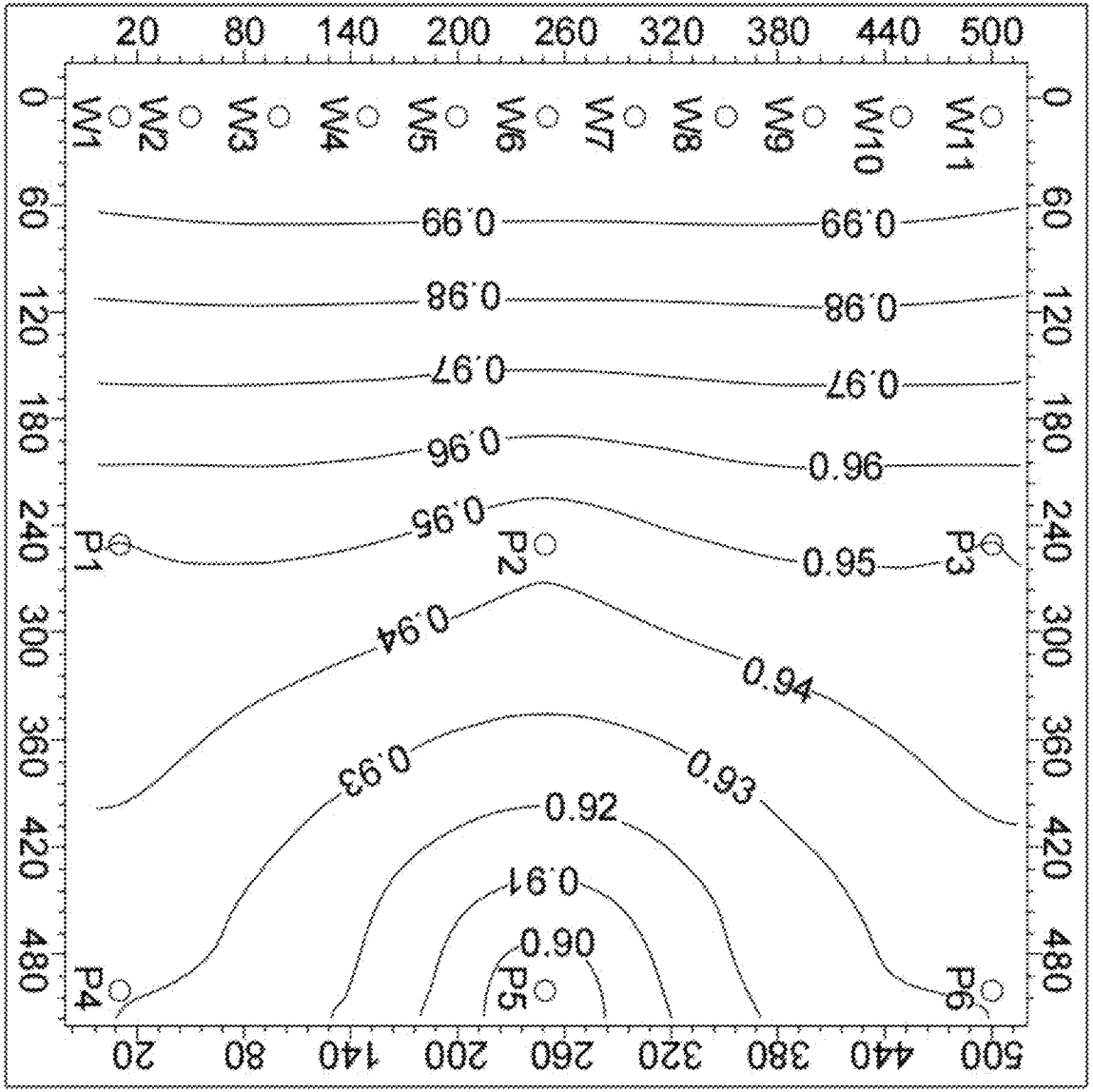
FIG. 7 is a diagram showing the water saturation distribution calculated by the model.

According to the fitting results, the characteristic values of the volume and the water influx of a concave aquifer unit were obtained. These characteristic parameters were combined together, and the aquifer distribution of concave edge water could be obtained intuitively, as shown in FIG. 6. On the basis of the characteristic parameters, namely the fitted volume and water influx of the aquifer unit, the dynamic characteristics of water influx were obtained by model inversion, as shown in FIG. 7.

What is claimed is:

1. An intelligent identification method of aquifer distribution in complex edge-water oil and gas reservoirs, implemented by a device comprising a processor, a display and a memory storing instructions executed by the processor, wherein the intelligent identification method comprising:

discretizing, by the processor, an edge aquifer into an aquifer unit communicated with a production well unit;

discretizing, by the processor, a position with clear geological knowledge into an infill unit;

based on the aquifer unit, the production well unit and the infill unit, establishing, by the processor, a simple edge-water oil and gas reservoir unit system, wherein the aquifer unit is characterized by a volume and a water influx of the aquifer unit;

based on the aquifer unit, the production well unit and the infill unit, calculating, by the processor, pressure of each unit by a material balance equation; and according to the calculated pressure of each unit, calculating, by the processor, saturation and water cut of each unit by using a waterflood front advancing equation to establish a numerical simulation model of a water influx unit to be stored in the memory;

establishing, by the processor, characteristic parameter vectors and an objective function of the aquifer unit according to the established numerical simulation model of the water influx unit;

setting, by the processor, constraints on the volume of the aquifer unit, the volume of the aquifer unit equal to a size of an entire edge-water aquifer;

automatically fitting, by the processor, the volume and the water influx of the aquifer unit by a genetic algorithm, until an error value between data predicted by the established numerical simulation model and actual dynamic production data is minimum, thereby obtaining a corrected volume and a corrected water influx of the aquifer unit;

assigning, by the processor, the corrected volume and corrected water influx of the aquifer unit to a discretized aquifer unit to establish and display an aquifer unit bar chart in the display, wherein an aquifer distribution is determined by the bar height of each unit; and based on the determined aquifer distribution, adjusting a production schedule of the production well unit to improve an oil reservoir recovery factor.

2. The intelligent identification method of aquifer distribution in complex edge-water oil and gas reservoirs according to claim 1, wherein the material balance equation is $$\sum_{j=1}^{n_{well}} T_{ji}^{t}\left(p_j^t - p_i^t\right) + w_i^t = c_t \cdot V_i^t \cdot \frac{dp_i^t}{dt},$$

where $$T_{ij}^{t}$$

is an average conductivity between the aquifer unit i and the production well unit j at time t, $m^3/(d \cdot MPa)$; nwell is a number of the production well units and infill units, dimensionless;

$$p_i^t$$

is aquifer pressure of the aquifer unit i at time t, MPa;

$$p_j^t$$

is average bottom hole pressure of the production well unit j at time t, MPa;

$$w_i^t$$

is the water influx of the aquifer unit i at time t, $m^3/d$; ct is a comprehensive formation compressibility, $MPa^{-1}$; and $$V_j^t$$

is the aquifer volume of the aquifer unit i at time t, $m^3$.

3. The intelligent identification method of aquifer distribution in complex edge-water oil and gas reservoirs according to claim 1, wherein the waterflood front advancing equation $$\left(\frac{dx}{dt}\right)_{Sw} = \frac{Q}{A\phi} \cdot \frac{\partial f_w}{\partial S_w},$$

where x is a position of a water influx channel, m; Q is total flow of fluid, $m^3$; $S_w$ is water saturation at position x, dimensionless; $f_w$ is partial flow of a water phase, dimensionless; A is a cross-sectional area of a seepage, $m^2$; and $\phi$ is porosity, dimensionless.

4. The intelligent identification method of aquifer distribution in complex edge-water oil and gas reservoirs according to claim 1, wherein the dynamic production data comprises bottom hole pressure of a single well and water cut of the single well.

* * * * *